United States Patent [19]

Newman et al.

[11] Patent Number: 4,925,413

[45] Date of Patent: May 15, 1990

[54] STERN DRIVE MARINE PROPULSION SYSTEM INCLUDING A CHAIN DRIVE MECHANISM

[75] Inventors: Neil A. Newman, Omro; Daniel F. McCormick, Oshkosh, both of Wis.

[73] Assignee: Brunswick Corporation, Skokie, Ill.

[21] Appl. No.: 244,994

[22] Filed: Sep. 15, 1988

[51] Int. Cl.[5] ..... B63H 21/28

[52] U.S. Cl. ..... 440/75

[58] Field of Search ..... 440/49, 65, 75, 78–83, 440/900

[56] References Cited

U.S. PATENT DOCUMENTS

| | | | |
|---|---|---|---|
| 743,700 | 11/1903 | Dupuis | 440/75 |
| 2,345,689 | 4/1944 | Snadecki | 440/75 |
| 2,486,574 | 11/1949 | Roof | 440/75 |
| 2,755,766 | 7/1956 | Wanzer | 440/75 |
| 2,809,605 | 10/1957 | Russell | 440/75 |
| 3,088,430 | 5/1963 | Champney | 440/75 |
| 3,403,655 | 10/1968 | Warburton | 440/75 |
| 3,584,593 | 6/1971 | Blount | 440/75 |
| 3,707,939 | 1/1973 | Berg | 440/75 |
| 3,795,219 | 3/1974 | Peterson | 440/75 |
| 3,922,997 | 12/1975 | Jameson | 440/75 |
| 3,951,096 | 4/1976 | Dunlap | 440/75 |
| 4,382,797 | 5/1983 | Blanchard | 440/75 |
| 4,408,994 | 10/1983 | Blanchard | 440/75 |

*Primary Examiner*—Joseph F. Peters, Jr.
*Assistant Examiner*—Jesus D. Sotelo
*Attorney, Agent, or Firm*—Andrus, Sceales, Starke & Sawall

[57] ABSTRACT

An inboard/outboard stern drive system incorporates a chain drive mechanism. A chain drive extends between the propeller shaft and an intermediate shaft mounted in the stern drive lower unit above the waterline during boat operation for driving the propeller shaft in response to rotation of the intermediate shaft. An input shaft is mounted in the upper portion of the stern drive lower unit, and is drivingly engageable with the intermediate shaft. Appropriate gears and/or sprockets are mounted to the input shaft and the intermediate shaft for transferring rotation therebetween. In a preferred embodiment, a reversing mechanism is employed for selectively imparting rotation to the intermediate shaft in either a first or second rotational direction, thereby controlling the direction of rotation of the propeller shaft. The reversing mechanism is disposed above the waterline during normal operation so as not to impinge on the submerged area of the lower unit. The location of the intermediate shaft above the waterline allows large reductions necessary to efficiently transfer power from the input shaft to the propeller shaft in high power applications, without increasing the frontal area of the submerged portion of the lower unit.

7 Claims, 2 Drawing Sheets

STERN DRIVE MARINE PROPULSION SYSTEM INCLUDING A CHAIN DRIVE MECHANISM

BACKGROUND AND SUMMARY

This invention relates to a marine propulsion system, and more particularly to an inboard/outboard stern drive system.

In a marine drive system, it is generally desirable to minimize the frontal area of the submerged drive components in order to reduce drag caused by such components during operation. This presents a difficult problem in high power applications when utilizing a standard perpendicular shaft/bevel gear power transfer arrangement. When the proper gear ratio is selected for the optimum propeller in a high power system, the diameter of the bevel gears increases, thereby causing an increase in the transverse dimension of the portion of the gearcase housing the bevel gears. The resulting increase in gearcase drag certainly detracts from the supposed increase in performance provided by the optimum propeller, and may even result in a decrease in overall performance. That is, the large propeller required for efficiently transferring power through the system requires a gear design furnishing large reduction ratios. Such large reduction ratios are only accomplished by increasing the size of the bevel gears, thereby increasing hydrodynamic drag of the torpedo.

If the diameter of the gearcase torpedo is reduced to a more desirable hydrodynamic size, resulting in a reduction in the size of the gears housed therein, then the gear ratio is likewise reduced to the extent that the propeller no longer operates efficiently.

One solution to the above-described problem is to design a small diameter gearcase in which the propeller runs in a semi-submerged condition. The smaller diameter propellers employed are suitable for the relatively light loads under such circumstances. As a result of such design, however, the low-speed performance of the boat is sacrificed.

Another approach is to employ an inboard system. However, when such a system is used in a high power application, the large diameter propeller required for efficient power transfer results in an increase of the propeller shaft angle in order for the propeller to clear the boat hull. With this arrangement, the vertical component of the propeller thrust increases, thus detracting from the forward component. One solution is to use a smaller diameter propeller, but this results in less efficient power transfer. Alternatively, the engine could be moved forward in the boat, but this encroaches on the interior space in the boat.

The present invention provides a solution to the noted problems encountered in a high power system. The invention contemplates a stern drive system in which the propeller shaft is provided with a sprocket, and is driven by a chain. The chain extends between the propeller shaft and an intermediate shaft located above the waterline during boat operation. The propeller shaft sprocket can be of a relatively small diameter, thereby reducing the frontal area of the gearcase torpedo, and the chain is relatively wide in order to accommodate the high power of the system. The intermediate shaft is disposed substantially parallel to the propeller shaft, and also to an input shaft provided in the upper portion of the gearcase. The input shaft is interconnected with the engine crankshaft so as to be rotatable in response thereto. A drive mechanism is provided between the input shaft and the intermediate shaft for transferring power therebetween. In one embodiment, the intermediate shaft has one or more relatively large diameter sprockets mounted thereto, and the input shaft has corresponding sprockets of relatively small diameter mounted thereto. Chains are provided about the input shaft and intermediate shaft sprockets, and the sprockets are designed to provide a relatively large reduction. This design supplies the large reduction ratios required to efficiently transfer power in a high power system to the large propeller optimally employed in such a system. With the intermediate shaft being located above the waterline during boat operation, the large diameter sprockets mounted thereto are housed within a portion of the gearcase housing which is not submerged during operation, thereby having no effect on the submerged frontal area of the gearcase. A reversing means is preferably provided for selectively imparting rotation to the intermediate shaft in either a first or second rotational direction. The reversing means preferably comprises a drive sprocket mounted to the input shaft and a corresponding driven sprocket mounted to the intermediate shaft, with a chain provided around the drive and driven sprockets. The input shaft also has a drive gear mounted thereto, engageable with a corresponding driven gear provided on the intermediate shaft. Clutch means is provided for selectively coupling either the drive gear or drive sprocket on the input shaft to the driven gear or driven sprocket on the intermediate shaft, thereby resulting in selective rotation of the intermediate shaft in either a first or second rotational direction.

The utilization of a chain drive system in a marine drive is shown in a number of prior art patents. Representative of such systems are U.S. Pat. No. 3,403,655 to Warburton, U.S. Pat. No. 3,951,096 to Dunlap and U.S. Pat. No. 3,088,430 to Champney. In the systems shown in the noted patents, sprockets are connected to the input shaft and to the propeller shaft. A chain is provided between the input shaft sprocket and the propeller shaft sprocket for driving the propeller shaft in response to rotation of the input shaft. However, the referenced patents do not employ an intermediate shaft between the input shaft and the propeller shaft, which allows the large reduction necessary to efficiently transfer high power to a large diameter propeller.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
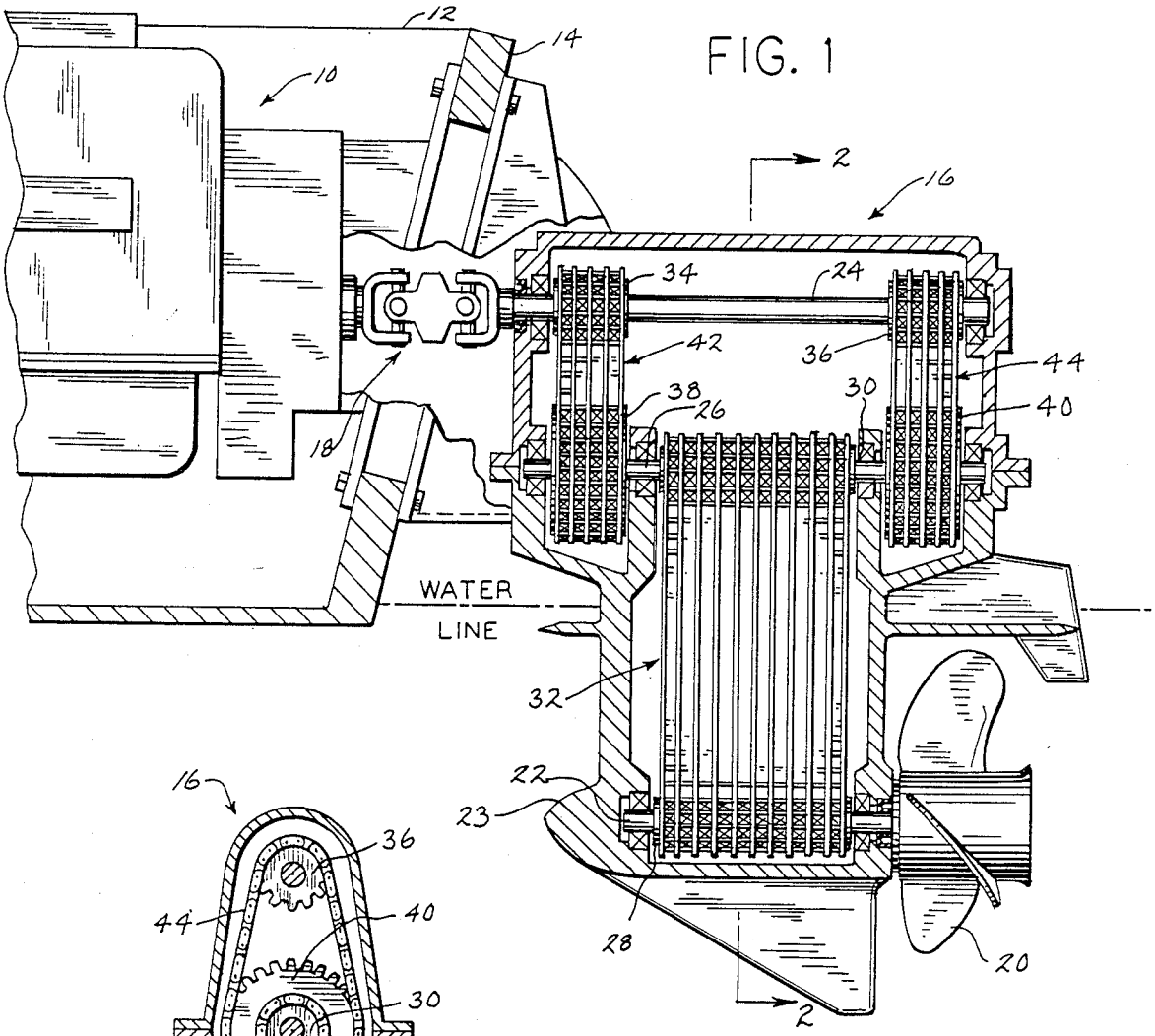
FIG. 1 is a partial side elevation view, partially in section, showing a marine propulsion stern drive system according to the invention.

With reference to FIG. 1, an inboard/outboard stern drive system generally includes an engine 10 mounted in the interior of a boat 12 adjacent its transom 14. A lower unit housing, shown generally at 16, is mounted to the exterior of boat transom 14. As is known, lower unit housing 16 is mounted for pivoting movement about a horizontal tilt axis and a vertical steering axis, such movement being accommodated by provision of a universal joint 18 between engine 10 and gearcase 16.

A propeller 20 is mounted to a propeller shaft 22, which is rotatably mounted in a torpedo 23 disposed in the lower portion of lower unit housing 16. An input shaft 24 is rotatably mounted in the upper portion of lower unit housing 16, and is drivingly interconnected with the crankshaft (not shown) of engine 10 through universal joint 18 so as to be rotatable in response to rotation thereof. An intermediate shaft 26 is rotatably mounted within lower unit housing 16 between propeller shaft 22 and input shaft 24. Intermediate shaft 26 is located so as to be above the waterline during operation of boat 12. Propeller shaft 22, intermediate shaft 26 and input shaft 24 are all substantially parallel to each other.

As a drive means for driving propeller shaft 22, a propeller shaft sprocket 28 is mounted to propeller shaft 22 and a driving sprocket 30 mounted to intermediate shaft 26. A wide chain 32 is provided about sprockets 28 and 30, for transferring rotation of intermediate shaft 26 to propeller shaft 22, and thereby to propeller 20.

As a drive means for driving intermediate shaft 26 in response to rotation of input shaft 24, input shaft 24 has a pair of driving sprockets 34, 36 mounted thereto and intermediate shaft 26 has a pair of driven sprockets 38, 40 mounted thereto. Driven sprockets 38, 40 on intermediate shaft 26 are substantially aligned with driving sprockets 34, 36 on input shaft 24. A pair of drive chains 42, 44 are provided about driving sprockets 34, 36 and driven sprockets 38, 40, respectively. In this manner, rotation of input shaft 24 is transferred through chains 42, 44 to intermediate shaft 26, and through chain 32 to propeller shaft 22.

Driven sprockets 38, 40 on intermediate shaft 26 are preferably of a larger diameter than driving sprockets 34, 36 on input shaft 24. With this design, it is possible to provide large gear reductions necessary to achieve efficient transfer of high power from input shaft 24 to propeller 20, while maintaining a relatively small frontal area of torpedo 23 within which propeller shaft 22 is mounted. Propeller 20 can thus be a relatively large diameter propeller necessary to accommodate a high power design without compromising boat performance.

Figure 2:
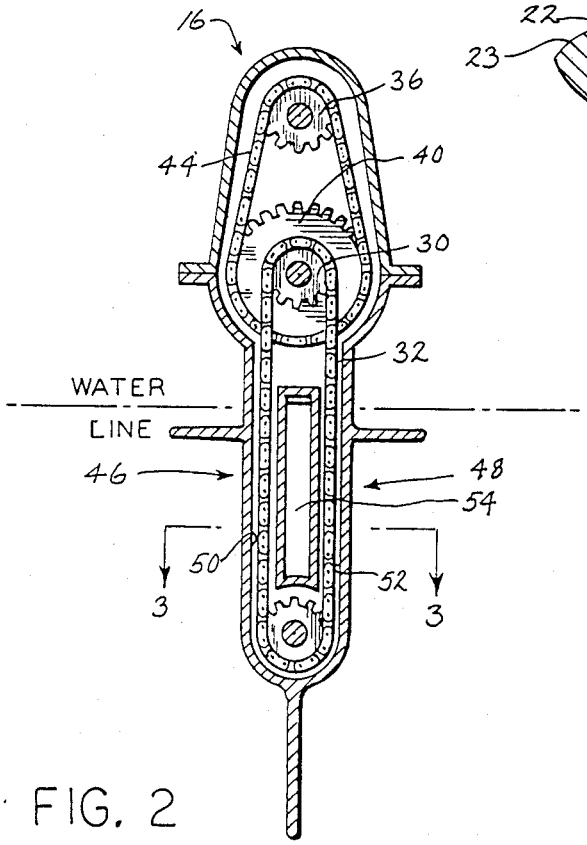
FIG. 2 is a sectional view taken generally along line 2—2 of FIG. 1.
Figure 3:
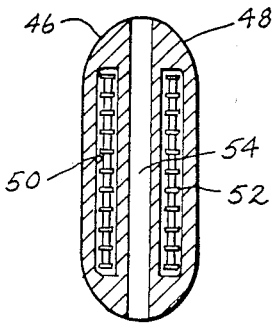
FIG. 3 is a sectional view taken generally along line 3—3 of FIG. 2.

With the provision of wide chain 32 between intermediate shaft 26 and propeller shaft 22, it is possible to construct the lower portion of gearcase 16 as shown in FIGS. 2 and 3. With this construction, a pair of downwardly extending struts 46, 48 accommodate passage of the vertically extending portions of chain 32 within passages 50, 52, formed therein. This enables the central portion of the lower unit between struts 46, 48 to be removed, thus creating a passage 54 between struts 46, 48. This provision of passage 54 further reduces the frontal area of the submerged portion of gearcase 16, resulting in a decrease in the hydrodynamic drag caused thereby.

As shown in FIG. 2, the vertically extending portions of chain 32 are substantially parallel as a result of sizing sprocket 30 on intermediate shaft 26 so as to be substantially the same diameter as sprocket 28 on propeller shaft 22.

Figure 4:
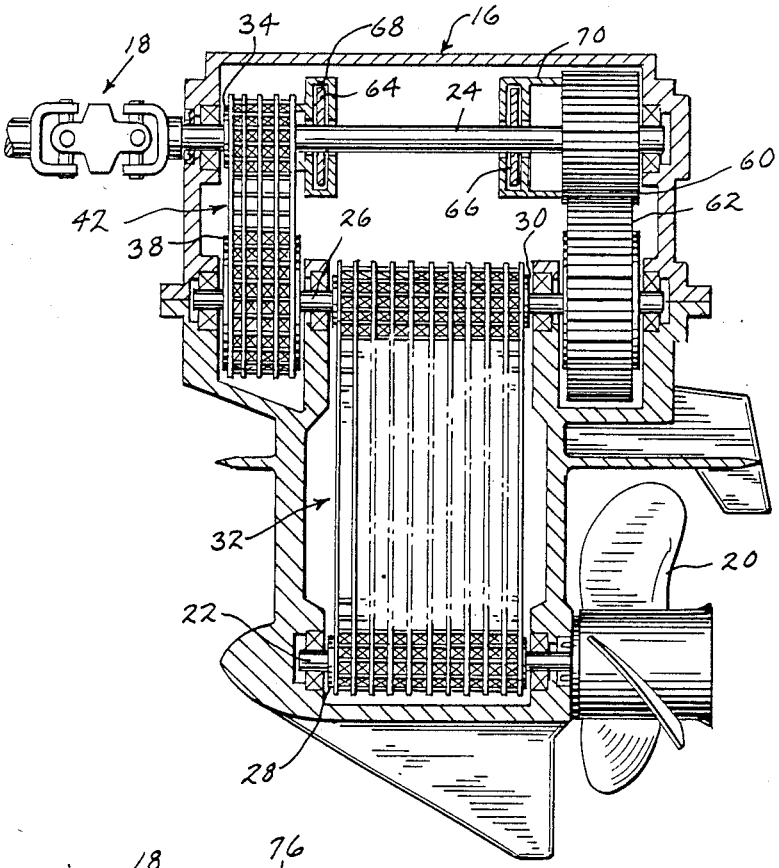
FIG. 4 is a partial elevation view similar to FIG. 1, showing an embodiment of the invention incorporating a reversing mechanism.
Figure 5:
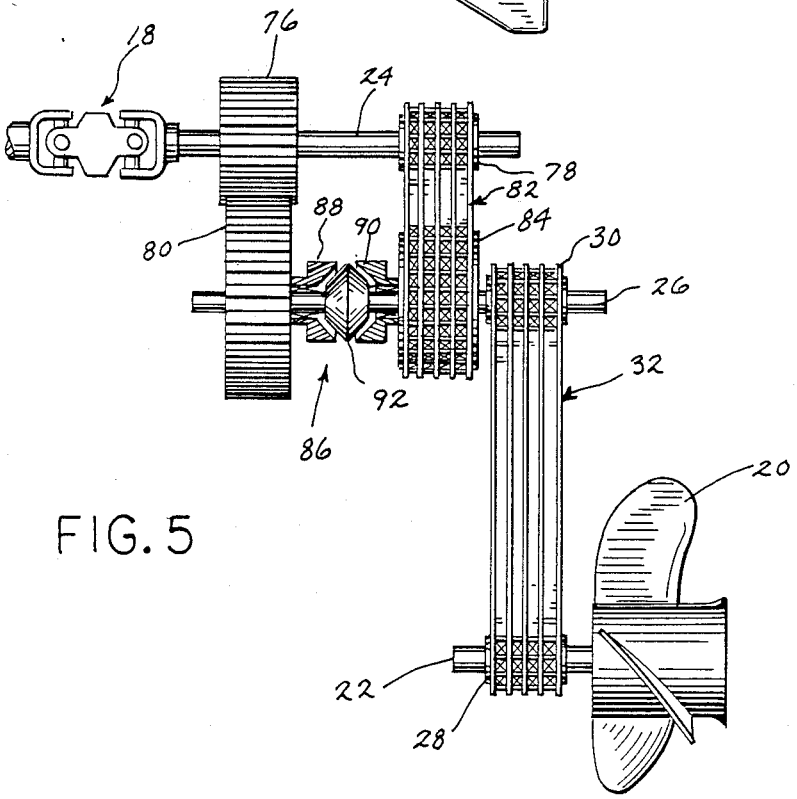
FIG. 5 is a partial elevation view similar to FIG. 4, showing an alternate reversing mechanism embodiment of the invention.

FIGS. 4 and 5 illustrate two embodiments for incorporating a reversing mechanism into the drive system of the invention, so as to provide for reversing operation of propeller 20. Where possible, like reference characters will be used to facilitate clarity.

As shown in FIG. 4, a drive gear 60 is mounted to the rearward portion of input shaft 24. Drive gear 60 is freely rotatable about input shaft 24, and is engageable with a driven gear 62 mounted to intermediate shaft 26 at its rearward end. Sprocket 34 mounted to the frontward end of input shaft 24 is also freely rotatable about input shaft 24.

Input shaft 24 has a pair of discs 64, 66 mounted thereto and rotatable therewith. A clutch mechanism 68 is mounted to and rotatable with drive sprocket 34, and a clutch mechanism 70 is mounted to and rotatable with drive gear 60. Clutch mechanisms 68, 70 are selectively actuable so as to selectively couple either drive sprocket 34 or drive gear 60 to input shaft 24 through discs 64, 66, respectively. In this manner, upon selective engagement of either clutch mechanism 68 or clutch mechanism 70, rotation of input shaft 24 causes rotation of intermediate shaft 26 in either a first or second rotational direction. Reversing operation of the marine drive system is thus provided.

With reference to FIG. 5, a drive gear 76 is mounted to the forward end of input shaft 24, and a drive sprocket 78 is mounted to the rearward end of input shaft 24. Drive gear 76 is engageable with a driven gear 80 mounted to and freely rotatable about intermediate shaft 26. Drive sprocket 78 is engageable through a chain 82 with a driven sprocket 84 mounted to and freely rotatable about intermediate shaft 26. In this embodiment, driving sprocket 30 on intermediate shaft 26 is located adjacent the rearward end of intermediate shaft 26.

A cone clutch 86 is provided on intermediate shaft 26 for selectively coupling either driven gear 80 or driven sprocket 84 to intermediate shaft 26. Clutch 86 includes a clutch engagement member 88 mounted to and rotatable with drive gear 80, and a clutch engagement member 90 mounted to and rotatable with driven sprocket 84. A cone 92 is mounted to and rotatable with intermediate shaft 26, and is selectively engaged by sliding movement on intermediate shaft 26 with either clutch engagement member 88 or clutch engagement member 99. Upon selective engagement of clutch cone 92 with either of clutch engagement members 88 or 90, rotation is imparted to intermediate shaft 26 in a desired rotational direction. Shifting of clutch cone 92 can be accomplished by employment of a conventional cone clutch shifting system.

Various alternatives and modifications are contemplated as being within the scope of the following claims particularly pointing out and distinctly claiming the invention.

We claim:

1. A stern drive marine propulsion system for a boat, comprising:

an engine including a rotatable crankshaft, said engine being disposed in the interior of the boat;

a stern drive lower unit housing adapted for mounting exteriorly of the boat and adjacent the transom of the boat;

a propeller shaft rotatably mounted in the lower portion of the lower unit housing;

a propeller mounted to the propeller shaft;

an input shaft rotatably mounted in the upper portion of the lower unit housing, said input shaft being interconnected with said engine crankshaft so as to be rotatable in response to rotation thereof;

an intermediate shaft mounted within the lower unit housing, said intermediate shaft being located between the propeller shaft and the input shaft and being substantially parallel to the propeller shaft, and said intermediate shaft being disposed above the waterline during operation of the boat;

first drive means disposed between said input shaft and said intermediate shaft for transferring rotation of said input shaft to said intermediate shaft;

second drive means disposed between said propeller shaft and said intermediate shaft for transferring rotation of said intermediate shaft to said propeller shaft, and thereby to said propeller, said second drive means comprising sprocket means associated with said intermediate shaft and said propeller shaft, and chain means drivingly engaged with said sprocket means for transferring rotation of said intermediate shaft to said propeller shaft through said sprocket means;

selectively engageable reversing means for selectively reversing the direction of rotation of said propeller shaft, and thereby of said propeller;

wherein said selectively engageable reversing means is located above the waterline during operation of the boat; and wherein said selectively engageable reversing means comprises:

a first driving member mounted to said input shaft;

a first driven member mounted to said intermediate shaft and engageable with said first driving member, said first driving and driven member cooperating to impart rotation to said intermediate shaft in a first rotational direction;

a second driving member mounted to said input shaft;

a second driven member mounted to said intermediate shaft and engageable with said second driving member, said second driving and driven members cooperating to impart rotation to said intermediate shaft in a second rotational direction opposite said first rotational direction; and clutch means for selectively coupling either said first driving and driven members or said second driving and driven members to said intermediate shaft for selectively imparting rotation to said intermediate shaft in either said first rotational direction or said second rotational direction.

2. The stern drive marine propulsion system of claim 1, wherein one of said first or second driving members comprises a sprocket mounted to said input shaft and the other of said first or second driving members comprises a gear, and wherein one of said first or second driven members comprises a sprocket mounted to said intermediate shaft and interconnected with the sprocket on said input shaft by means of a chain, and the other of said first or second driven members comprises a gear engageable with the gear mounted to said input shaft, said clutch means selectively coupling either said gears or said sprockets and chain to said intermediate shaft for controlling the direction of rotation thereof.

3. The stern drive marine propulsion system of claim 2, wherein said gear and said sprocket mounted to said input shaft are mounted for free rotation thereabout, and wherein said clutch means selectively couples either said gear or said sprocket to said input shaft for controlling the direction of rotation of said intermediate shaft.

4. The stern drive marine propulsion system of claim 3, wherein said input shaft includes a pair of discs rigidly mounted thereto, with one said disc being mounted adjacent said gear mounted to said input shaft and the other said disc being mounted adjacent said sprocket mounted to said input shaft, and wherein said clutch means includes a clutch mechanism associated with said gear mounted to said input shaft for selectively engaging the input shaft disc mounted adjacent thereto for imparting rotation to said gear, and a clutch mechanism associated with said sprocket mounted to said input shaft for selectively engaging the input shaft disc mounted adjacent thereto for imparting rotation to said sprocket.

5. The stern drive marine propulsion system of claim 2, wherein said gear and said sprocket mounted to said intermediate shaft are mounted for free rotation thereabout, and wherein said clutch means selectively couples either said gear or said sprocket to said intermediate shaft for controlling the direction of rotation thereof.

6. The stern drive marine propulsion system of claim 5, wherein said gear and said sprocket mounted to said intermediate shaft each include a clutch engagement member mounted thereto and rotatable therewith, and wherein said clutch means selectively engages either said clutch engagement member mounted to said gear or said clutch engagement member mounted to said sprocket for transferring rotation of either said gear or said sprocket to said intermediate shaft for controlling the direction of rotation thereof.

7. A stern drive marine propulsion system for a boat, comprising:

an engine including a rotatable crankshaft, said engine being disposed in the interior of the boat;

a stern drive lower unit housing adapted for mounting to the exterior of the boat adjacent the transom of the boat;

a propeller shaft rotatably mounted in the lower portion of the lower unit housing;

a propeller mounted to the propeller shaft;

an input shaft rotatably mounted in the upper portion of the lower unit housing and interconnected with said engine crankshaft so as to be rotatable in response to rotation thereof, said input shaft being substantially parallel to said propeller shaft;

an intermediate shaft mounted within the lower unit housing, said intermediate shaft being disposed between the propeller shaft and the input shaft and oriented so as to be substantially parallel to each, said intermediate shaft being disposed above the waterline during operation of the boat;

first drive means disposed between said input shaft and said intermediate shaft for transferring rotation of said input shaft to said intermediate shaft, said first drive means including reversing means for selectively imparting rotation to said intermediate shaft in either a first or second rotational direction, said reversing means being disposed above the waterline during operation of the boat; and second drive means disposed between said intermediate shaft and said propeller shaft for transferring rotation of said intermediate shaft to said propeller shaft and thereby to said propeller, said second drive means including first sprocket means mounted to said intermediate shaft and second sprocket means mounted to said propeller shaft, and chain means provided about said first and second sprocket means for driving said propeller shaft in response to rotation of said intermediate shaft.

* * * * *